US012392345B2

(12) United States Patent
Lee et al.

(10) Patent No.: US 12,392,345 B2
(45) Date of Patent: Aug. 19, 2025

(54) IMPELLER DRIVING DEVICE FOR COOLING PUMP OF ELECTRIC OUTBOARD DEVICE

(71) Applicant: AIWIN CO., LTD., Anyang-si (KR)

(72) Inventors: Woo Won Lee, Anyang-si (KR); Yong Seung Kim, Yongin-si (KR); Ho Pyang Ryu, Anyang-si (KR); Sang Soo Park, Suwon-si (KR); Jeong Hyun Seong, Seoul (KR)

(73) Assignee: AIWIN CO., LTD., Anyang-si (KR)

( * ) Notice: Subject to any disclaimer, the term of this patent is extended or adjusted under 35 U.S.C. 154(b) by 81 days.

(21) Appl. No.: 18/403,423

(22) Filed: Jan. 3, 2024

(65) Prior Publication Data

US 2024/0280108 A1 Aug. 22, 2024

Related U.S. Application Data

(63) Continuation of application No. PCT/KR2023/005082, filed on Apr. 14, 2023.

(30) Foreign Application Priority Data

Feb. 22, 2023 (KR) ..... 10-2023-0023387

(51) Int. Cl.

| | |
|---|---|
| ***F04D 13/06*** | (2006.01) |
| ***B63H 20/28*** | (2006.01) |
| ***F04D 13/02*** | (2006.01) |
| ***F04D 25/02*** | (2006.01) |
| ***F04D 25/06*** | (2006.01) |

(Continued)

(52) U.S. Cl.

CPC ..... *F04D 13/06* (2013.01); *B63H 20/28* (2013.01); *F04D 13/02* (2013.01); *F04D 25/02* (2013.01); *F04D 25/06* (2013.01); *F04D 29/406* (2013.01); *F04D 29/426* (2013.01)

(58) Field of Classification Search

CPC ..... F04D 13/02; F04D 13/06; F04D 25/02; F04D 25/06; F04D 29/406; F04D 29/426; B63H 20/28

USPC ..... 417/423.1, 423.6, 423.14

See application file for complete search history.

(56) References Cited

U.S. PATENT DOCUMENTS 6,146,223 A 11/2000 Karls et al.

FOREIGN PATENT DOCUMENTS

CN 107939698 A * 4/2018 ..... F04D 13/02
CN 109538482 A * 3/2019
CN 111852891 A * 10/2020

(Continued)

OTHER PUBLICATIONS

International Search Report issued in PCT/KR2023/005082; mailed Nov. 9, 2023.

(Continued)

*Primary Examiner* — Jorge L Leon, Jr.

(74) *Attorney, Agent, or Firm* — Studebaker Brackett PLLC

(57) ABSTRACT

The present disclosure relates to an impeller driving device for a cooling pump of an electric outboard device, configured so that a gearbox housing is installed on an outboard-device body and an impeller housing is installed against an outer surface of a right side of the gearbox housing on the outboard-device body to drive the impeller for the cooling pump of the electric outboard device.

1 Claim, 1 Drawing Sheet

(51) Int. Cl.
*F04D 29/40* (2006.01)
*F04D 29/42* (2006.01)

(56) References Cited

FOREIGN PATENT DOCUMENTS

| | | | | |
|---|---|---|---|---|
| CN | 115306729 | A | * | 11/2022 |
| JP | 2018013072 | A | * | 1/2018 |
| KR | 10-2011-0011091 | A | | 2/2011 |
| KR | 10-2012-0020943 | A | | 3/2012 |
| KR | 10-2014-0069538 | A | | 6/2014 |
| KR | 10-2284213 | B1 | | 8/2021 |
| KR | 10-2021-0134730 | A | | 11/2021 |

OTHER PUBLICATIONS

Written Opinion of the International Searching Authority issued in PCT/KR2023/005082; mailed Nov. 9, 2023.

* cited by examiner

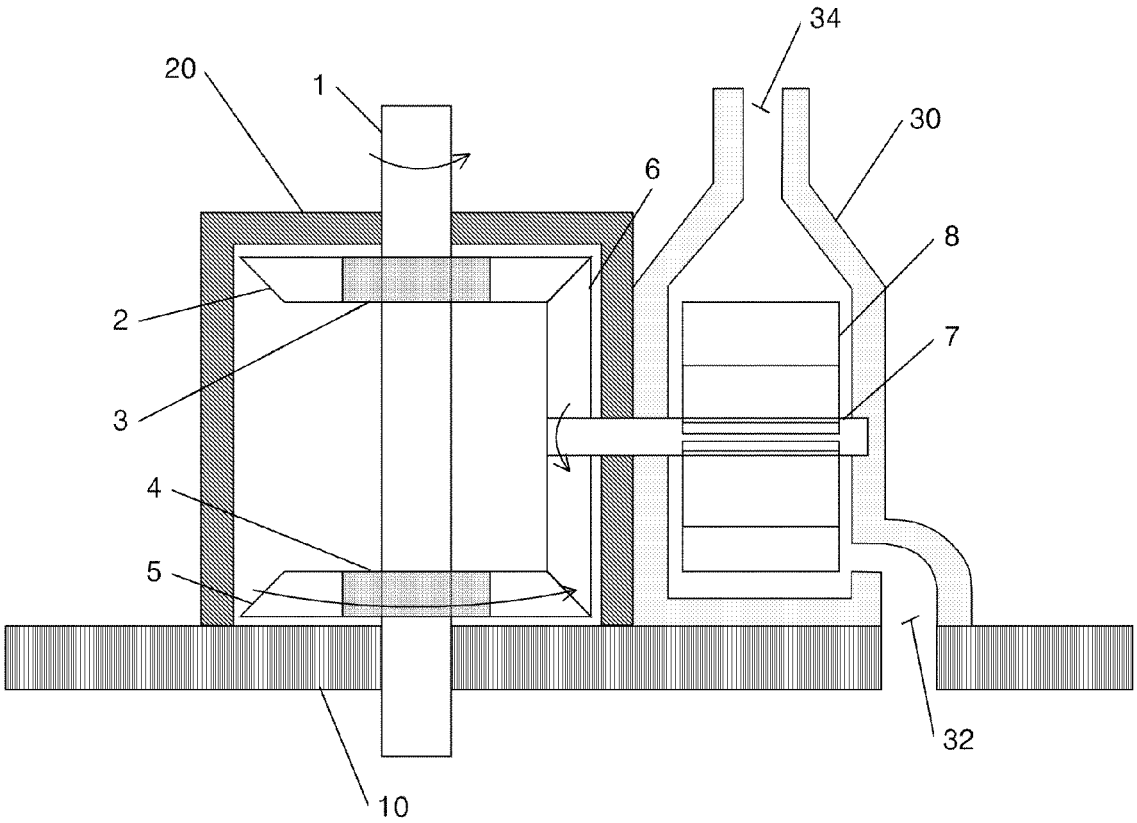
34
20
1
30
6
8
2
7
3
4
5
32
10

IMPELLER DRIVING DEVICE FOR COOLING PUMP OF ELECTRIC OUTBOARD DEVICE

CROSS-REFERENCE TO RELATED APPLICATIONS

This application is a Continuation of International Application No. PCT/KR2023/005082 filed Apr. 14, 2023, which claims benefit of priority to Korean Patent Application No. 10-2023-0023387 filed Feb. 22, 2023, the entire contents of which are incorporated herein by reference.

TECHNICAL FIELD

The present disclosure relates to an impeller driving device for a cooling pump of an electric outboard device.

BACKGROUND ART

An electric outboard device is driven using electricity, and an internal-combustion-engine outboard device is driven using liquid fuel.

The electric outboard device may control the rotating direction of a propeller shaft by changing an electric signal applied to a motor. The internal-combustion-engine outboard device may control the rotating direction of the propeller shaft through a clutch and a gear device. A cooling pump of the electric outboard device and a cooling pump of the internal-combustion-engine outboard device are driven using the rotating force of the propeller shaft. Here, the cooling pump of the internal-combustion-engine outboard device is a pump for cooling the internal combustion engine, and the cooling pump of the electric outboard device is a pump for cooling the motor.

In the case that an impeller used in the cooling pump of the internal-combustion-engine outboard device is applied to the electric outboard device, an impeller blade may be overloaded and damaged whenever the rotating direction of the impeller blade changes. That is, the impeller blade installed in an impeller housing is formed with a blade portion curved, thus preventing pressure from escaping during rotation. Each time the impeller blade rotates in reverse, overload may be applied to the blade portion and the blade may be broken.

Further, as the electric outboard device available in the market does not use a direct water cooling method but uses an air cooling or heat exchange method because of the impeller problem, cooling efficiency is deteriorated. For this reason, this is not applied to a large electric outboard device but is applied to only a small electric outboard device.

Therefore, it is necessary to implement a large electric outboard device through the following configuration. Regardless of the rotating direction of the propeller shaft provided in a propeller driving motor, the impeller blade in the impeller housing is configured to rotate only in one direction, thus enabling the direct water cooling of the motor. As a result, the impeller blade is not subject to overload due to reverse rotation, so damage to the blade is prevented. Further, the direct cooling method can be applied, thus increasing the cooling efficiency and producing higher output compared to the air cooling or heat exchange method.

As the related art, there has been proposed Korean Patent No. 10-2284213 (publication date: Aug. 3, 2021) entitled "Detachable portable water jet propulsion unit".

The "detachable portable water jet propulsion unit" according to the related art is operated while floating on a water surface.

However, the "detachable portable water jet propulsion unit" of Korean Patent No. 10-2284213 is operated while floating on the water surface, and does not perform the direct water cooling of the motor by rotating an impeller blade in an impeller housing only in one direction, regardless of the rotating direction of a propeller shaft provided in a propeller driving motor.

DETAILED DESCRIPTION

Technical Problems

Accordingly, the present disclosure has been made keeping in mind the above problems occurring in the related art, and an object of the present disclosure is to provide an impeller driving device for a cooling pump of an electric outboard device, in which an impeller blade in an impeller housing is configured to rotate only in one direction, regardless of the rotating direction of a propeller shaft provided in a propeller driving motor, thus enabling the direct water cooling of the motor.

Technical Solution

In order to accomplish the above-mentioned object, an aspect of the present disclosure provides an impeller driving device for a cooling pump of an electric outboard device, configured so that a gearbox housing (20) is installed on an outboard-device body (10) and an impeller housing (30) is installed against an outer surface of a right side of the gearbox housing (20) on the outboard-device body (10) to drive the impeller for the cooling pump of the electric outboard device.

A propeller shaft (1) provided in a propeller driving motor passes vertically through a central portion of the gearbox housing (20) and the outboard-device body (10).

In the gearbox housing (20), a first bevel gear (2) having on a center thereof a first one-way bearing (3) that is locked clockwise and unlocked counterclockwise is coupled to an upper portion of the propeller shaft (1), a second bevel gear (5) having on a center thereof a second one-way bearing (4) that is locked counterclockwise and unlocked clockwise is coupled to a lower portion of the propeller shaft (1), and a third bevel gear (6) having on a center thereof the impeller shaft (7) that is coupled to extend to the right and penetrates the gearbox housing (20) and an inside of the impeller housing (30) is positioned between a right side of the first bevel gear (2) and a right side of the second bevel gear (5) to transmit rotating force of the first and second bevel gears (2, 5) as counterclockwise rotating force.

In the impeller housing (30), an impeller blade (8) is installed on a right side of the impeller shaft (7), so that, as the propeller shaft (1) rotates clockwise or counterclockwise, the impeller blade rotates counterclockwise, thus sucking water through an inlet (32) that is provided in a lower portion of the impeller housing (30) and discharging water through an outlet (34) that is provided in an upper portion of the impeller housing (30), whereby direct water cooling of the propeller driving motor is performed.

Effect of Invention

The present disclosure has the following effect: regardless of the rotating direction of a propeller shaft 1 provided in a propeller driving motor, an impeller blade 8 in the impeller housing 30 is configured to rotate only in one direction, thus enabling the direct water cooling of the motor. As a result, the impeller blade 8 is not subject to overload due to reverse rotation, so damage to the blade is prevented. Further, a direct cooling method can be applied, thus increasing cooling efficiency and producing higher output compared to an air cooling or heat exchange method.

BRIEF DESCRIPTION OF THE DRAWING

The FIGURE is a diagram illustrating an impeller driving device for a cooling pump of an electric outboard device according to an embodiment of the present disclosure.

BEST MODE

Hereinafter, an embodiment of the present disclosure will be described in detail with reference to the accompanying drawing.

The FIGURE is a diagram illustrating an impeller driving device for a cooling pump of an electric outboard device according to an embodiment of the present disclosure. The device includes a propeller shaft 1, first, second, and third bevel gears 2, 5 and 6, first and second one-way bearings 3 and 4, an impeller shaft 7, an impeller blade 8, an outboard-device body 10, a gearbox housing 20, an impeller housing 30, an inlet 32, and an outlet 34.

The present disclosure will be described below in detail.

Referring to the FIGURE, the present disclosure is a device in which the gearbox housing (20) is installed on the outboard-device body (10) and the impeller housing (30) is installed against an outer surface of a right side of the gearbox housing (20) on the outboard-device body (10) to drive the impeller for the cooling pump of the electric outboard device.

The propeller shaft (1) provided in the propeller driving motor passes vertically through the central portion of the gearbox housing (20) and the outboard-device body (10).

In the gearbox housing (20), the first bevel gear (2) having on a center thereof the first one-way bearing (3) that is locked clockwise and unlocked counterclockwise is coupled to an upper portion of the propeller shaft (1), the second bevel gear (5) having on a center thereof the second one-way bearing (4) that is locked counterclockwise and unlocked clockwise is coupled to a lower portion of the propeller shaft (1), and the third bevel gear (6) having on a center thereof the impeller shaft (7) that is coupled to extend to the right and penetrates the gearbox housing (20) and the inside of the impeller housing (30) is positioned between the right side of the first bevel gear (2) and the right side of the second bevel gear (5) to transmit the rotating force of the first and second bevel gears (2 and 5) as the counterclockwise rotating force. That is, as the first bevel gear (2) may rotate clockwise and the second bevel gear (5) may rotate counterclockwise, the impeller shaft (7) always rotates counterclockwise.

In the impeller housing (30), the impeller blade (8) is installed on the right side of the impeller shaft (7). As the propeller shaft 1 rotates clockwise or counterclockwise, the impeller blade rotates counterclockwise, thus sucking water through the inlet (32) that is provided in a lower portion of the impeller housing (30) and discharging water through the outlet (34) that is provided in an upper portion of the impeller housing (30). In this way, the direct water cooling of the propeller driving motor is performed.

Since the impeller driving device for the cooling pump of the electric outboard device according to the present disclosure is implemented as described above, an inexpensive impeller blade for an internal combustion engine that is widely available on the market can be used as is.

According to the present disclosure, it is advantageously possible to implement a large electric outboard device through the following configuration. Regardless of the rotating direction of the propeller shaft (1) provided in the propeller driving motor, the impeller blade (8) in the impeller housing (30) is configured to rotate only in one direction, thus enabling the direct water cooling of the motor. As a result, the impeller blade (8) is not subject to overload due to reverse rotation, so damage to the blade is prevented. Further, the direct cooling method can be applied, thus increasing cooling efficiency and producing higher output compared to the air cooling or heat exchange method.

Although the technical idea of the present disclosure has been described above with reference to the accompanying drawings, the preferred embodiment of the present disclosure is illustrative and not restrictive. In addition, it is apparent to those skilled in the art that various changes and modifications may be made without departing from the scope of the technical idea of the present disclosure.

What is claimed is:

1. An impeller driving device for a cooling pump of an electric outboard device, the impeller driving device comprising:

a gearbox housing mounted to a body of the outboard device;

an impeller housing mounted to the body against a wall of the gearbox housing, the impeller housing including a lower portion defining an inlet, and an upper portion defining an outlet;

a propeller shaft of a propeller driving motor extending vertically through a central portion of the body and the gearbox housing;

an impeller shaft of the cooling pump extending horizontally through the wall of the gearbox housing and into the impeller housing;

a gear assembly arranged in the gearbox housing, the gear assembly including:

a first bevel gear mounted to an upper portion of the propeller shaft via a first one-way bearing such that the first bevel gear is rotationally coupled to the propeller shaft when the propeller shaft rotates in a first direction, and the first bevel gear is rotationally decoupled from the propeller shaft when the propeller shaft rotates in a second direction, a second bevel gear mounted to a lower portion of the propeller shaft via a second one-way bearing such that the second bevel gear is rotationally decoupled from the propeller shaft when the propeller shaft rotates in the first direction, and the second bevel gear is rotationally coupled to the propeller shaft when the propeller shaft rotates in the second direction, and a third bevel gear mounted to a first end of the impeller shaft such that the third bevel gear meshes with the first bevel gear and the second bevel gear so as to transmit a rotating force of the propeller shaft to the impeller shaft; and an impeller blade mounted to a second end of the impeller shaft within the impeller housing, the impeller blade configured to suck cooling water through the inlet and discharge the cooling water through the outlet when the rotating force is transmitted to the impeller shaft thereby directly cooling the propeller driving motor, wherein the gear assembly is configured to rotate the impeller shaft in only one direction when the propeller shaft rotates in the first direction and when the propeller shaft rotates in the second direction.

* * * * *